US012697697B2

(12) United States Patent
Wosniak et al.

(10) Patent No.: US 12,697,697 B2
(45) Date of Patent: Aug. 4, 2026

(54) ABRASIVE FLOW MACHINE, METHOD FOR ASCERTAINING MATERIAL REMOVAL ON A WORKPIECE, AND METHOD FOR DETERMINING THE CUTTING POWER OF A GRINDING MEDIUM

(71) Applicant: Extrude Hone GmbH, Holzguenz (DE)

(72) Inventors: Fabio Augusto Wosniak, Holzguenz (DE); Patrick Matt, Holzguenz (DE)

(73) Assignee: Extrude Hone GmbH, Holzguenz (DE)

( * ) Notice: Subject to any disclaimer, the term of this patent is extended or adjusted under 35 U.S.C. 154(b) by 717 days.

(21) Appl. No.: 17/631,132

(22) PCT Filed: Jul. 30, 2020

(86) PCT No.: PCT/EP2020/071527

§ 371 (c)(1),
(2) Date: Jan. 28, 2022

(87) PCT Pub. No.: WO2021/019024

PCT Pub. Date: Feb. 4, 2021

(65) Prior Publication Data

US 2022/0258298 A1 Aug. 18, 2022

(30) Foreign Application Priority Data

Jul. 31, 2019 (DE) ..... 10 2019 120 753.3

(51) Int. Cl.
*B24B 31/116* (2006.01)
*B24B 49/04* (2006.01)

(52) U.S. Cl.
CPC ..... *B24B 31/116* (2013.01); *B24B 49/04* (2013.01)

(58) Field of Classification Search
CPC ..... B24B 31/00; B24B 31/116
(Continued)

(56) References Cited

U.S. PATENT DOCUMENTS 4,005,549 A 2/1977 Perry
4,865,042 A * 9/1989 Umemura ..... G10K 11/346 310/334

(Continued)

FOREIGN PATENT DOCUMENTS

CN 1558811 A 12/2004
CN 101530320 A 9/2009

(Continued)

*Primary Examiner* — Brian D Keller
*Assistant Examiner* — Jason Khalil Hawkins
(74) *Attorney, Agent, or Firm* — The Webb Law Firm

(57) ABSTRACT

An abrasive flow machine is indicated, having a media drive device which is adapted to move the abrasive medium over a surface of a workpiece and/or through the opening of the workpiece in a flow direction, having a workpiece holder for mounting the workpiece with two parts adapted to be positioned on opposite sides of the workpiece, having a structure-borne sound sensor for measuring structure-borne sound generated in a workpiece when the latter is machined with an abrasive medium, and having an evaluation unit which is adapted to infer a cutting power of the abrasive medium and/or a rate of material removal on the workpiece based on an integrated measurand of the root mean square of the structure-borne sound measured by the structure-borne sound sensor over time. Further indicated are a method of ascertaining a material removal on a workpiece and a method of determining the cutting power of an abrasive medium.

7 Claims, 5 Drawing Sheets

(58) Field of Classification Search
USPC ... 451/5, 8, 10, 11, 36, 59, 60, 61, 104, 113
See application file for complete search history.

(56) References Cited

U.S. PATENT DOCUMENTS

| | | | | |
|---|---|---|---|---|
| 5,245,794 | A | 9/1993 | Salugsugan | |
| 6,165,051 | A * | 12/2000 | Weisshaus | B28D 5/0064 451/8 |
| 6,319,094 | B1 * | 11/2001 | Williams | B24B 49/04 451/36 |
| 6,346,202 | B1 * | 2/2002 | Molnar | B24B 37/042 451/36 |
| 6,910,942 | B1 | 6/2005 | Dornfeld et al. | |
| 6,935,925 | B1 * | 8/2005 | Agrawal | G11B 5/8404 451/63 |
| 7,775,854 | B1 * | 8/2010 | Boman | B24C 9/006 451/88 |
| 10,369,673 | B2 | 8/2019 | Veittinger | |
| 2002/0173223 | A1 | 11/2002 | Gitis et al. | |
| 2005/0118931 | A1 * | 6/2005 | Greenslet | B24B 31/116 451/36 |
| 2006/0234606 | A1 * | 10/2006 | Lebkuechner | B24B 31/116 451/36 |
| 2013/0122784 | A1 | 5/2013 | Sung | |
| 2018/0021908 | A1 * | 1/2018 | Veittinger | B23Q 5/043 451/8 |
| 2019/0308292 | A1 * | 10/2019 | Nagalingam | B08B 9/0322 |
| 2020/0156210 | A1 | 5/2020 | Sullivan et al. | |

FOREIGN PATENT DOCUMENTS

| | | | |
|---|---|---|---|
| CN | 109702648 | A | 5/2019 |
| DE | 10309456 | A1 | 9/2004 |
| DE | 102008062081 | A1 | 6/2010 |
| DE | 202015001082 | U1 | 4/2015 |
| EP | 0214782 | * | 3/1987 |
| EP | 0739687 | A2 | 10/1996 |
| EP | 1159107 | A2 | 12/2001 |
| IN | 201917025107 | A | 8/2019 |
| JP | S5216095 | A | 2/1977 |
| JP | S534290 | A | 1/1978 |
| JP | S5831945 | U | 3/1983 |
| JP | S59175942 | A | 10/1984 |
| JP | H5154833 | A | 6/1993 |
| KR | 101696789 | B1 | 1/2017 |
| WO | 01047667 | A1 | 7/2001 |
| WO | 03035325 | A1 | 5/2003 |
| WO | 2018199312 | A1 | 11/2018 |

* cited by examiner

ABRASIVE FLOW MACHINE, METHOD FOR ASCERTAINING MATERIAL REMOVAL ON A WORKPIECE, AND METHOD FOR DETERMINING THE CUTTING POWER OF A GRINDING MEDIUM

CROSS-REFERENCE TO RELATED APPLICATIONS

This application is the United States national phase of International Application No. PCT/EP2020/071527 filed Jul. 30, 2020, and claims priority to German Patent Application No. 10 2019 120 753.3 filed Jul. 31, 2019, the disclosures of which are hereby incorporated by reference in their entirety.

BACKGROUND OF THE INVENTION

Field of the Invention

The invention relates to an abrasive flow machine, a method of ascertaining a material removal and/or a rate of material removal on a workpiece when the workpiece is machined in an abrasive flow machine, and a method of determining the cutting power of an abrasive or grinding medium.

Description of Related Art

Abrasive flow machines are used for polishing and abrasive finishing of workpieces by passing an abrasive medium under pressure over the workpiece or through an opening extending through the workpiece, with the abrasive medium removing material from the workpiece in the process. The abrasive medium is typically a viscous medium, in particular silicone-based, that includes abrasive particles.

The abrasive particles of the abrasive medium wear off as the workpiece is machined, as a result of which the cutting power of the abrasive medium and a material removal rate decrease. In addition, removed particles remain in the abrasive medium. Machining of the workpiece thus becomes less effective and unpredictable.

The cutting power of a still unused abrasive medium is generally known. However, it is difficult to determine the cutting power of an abrasive medium that has already been in use for a certain time. This is further complicated by the fact that when the abrasive medium has been worn, not the entire amount of abrasive medium present in the abrasive flow machine is replaced, but only a certain portion of the worn abrasive medium is taken out and replaced by unused abrasive medium, so that at no time is exact information available about the cutting power of the abrasive medium.

Experienced users are able to feel manually whether an abrasive medium still has sufficient cutting power or whether it has to be replaced, at least in part, by unused abrasive medium. However, such a determination of the cutting power is very inaccurate and can hardly be carried out by inexperienced users. During the operation of the abrasive flow machine, it is not possible to assess the abrasive medium.

If the abrasive medium is replaced too early, this will result in increased costs since still usable abrasive medium will be disposed of. If the abrasive medium is replaced too late, the material removal rate may decrease to such an extent that workpieces are not sufficiently abraded and this may lead to poor-quality parts being produced.

It is therefore an object of the present invention to provide an abrasive flow machine that allows a particularly efficient machining of workpieces. Furthermore, it is an object of the invention to indicate a method of ascertaining a material removal and/or a material removal rate on a workpiece as well as methods of determining the cutting power of an abrasive medium.

SUMMARY OF THE INVENTION

The invention provides an abrasive flow machine for moving abrasive media over a surface of a workpiece and/or through the opening of a workpiece, including a media drive device which is adapted to move the abrasive medium over a surface of a workpiece and/or through the opening of the workpiece along a flow direction, including a workpiece holder for mounting the workpiece with two parts adapted to be positioned on opposite sides of the workpiece, including a structure-borne sound sensor for measuring structure-borne sound generated in a workpiece when the latter is machined with an abrasive medium, and including an evaluation unit which is adapted to infer a cutting power of the abrasive medium and/or a rate of material removal on the workpiece based on an integrated measurand of the root mean square of the structure-borne sound measured by the structure-borne sound sensor over time.

Structure-borne sound occurs in the form of acoustic and/or elastic waves in solids when a material experiences irreversible changes in its internal structure, for example as a consequence of crack formation or plastic deformation due to aging or temperature gradients, but also due to targeted external mechanical forces when a solid is worked or machined. Mechanical machining processes can thus be monitored by measuring structure-borne sound signals using a structure-borne sound sensor. The frequency of the structure-borne sound waves is, in particular, between 50 kHz and 1 MHz here.

The greater the cutting power or the material removal rate, the stronger the structure-borne sound signal. This means that based on the structure-borne sound signal, it can be determined whether the machining of a workpiece is effective. There is a high correlation here between the root mean square of the structure-borne sound signal and the material removal rate. In particular, the root mean square of the structure-borne sound measured by the structure-borne sound sensor is related to a frictional energy dissipation during the machining of the workpiece.

The integrated measurand of the root mean square of the structure-borne sound measured by the structure-borne sound sensor over time is specific to a particular material removal. This means that the integrated measurand obtained can be used to indirectly determine a weight loss of the workpiece. In this way, an absolute material removal can be determined already during the machining of the workpiece. The integrated measurand is given, for example, in the unit of millivolt-seconds [mV·s]. Alternatively, the integrated measurand may also be given in the unit of milliampere-seconds [mA·s].

By means of the weight loss, the cutting power of the abrasive medium and/or the material removal rate can in turn be determined. This allows a particularly reliable process monitoring and a particularly precise machining of the workpiece. It has been found that a calculation of the material removal by means of the integrated measurand of the root mean square allows particularly accurate values to be ascertained for the material removal rate and for the cutting power.

The integral is formed, for example, over a continuous value of the root mean square of the structure-borne sound signal.

The material removal rate is calculated in particular by dividing the value of the material removal by the machining time.

The cutting power can be ascertained by dividing the material removal by the media flow rate. The media flow rate corresponds to the amount of fluid moved over the surface of the workpiece and/or through the opening of the workpiece.

The flow rate depends on the flow cross-section and the flow velocity of the abrasive medium and can therefore be easily ascertained. In particular, the evaluation unit may be configured to ascertain the media flow rate based on the process parameters that have been set. The flow cross-section is known and corresponds, for example, to the cross-section of the opening of the workpiece machined.

For calculating the integrated measurand, a suitable software is preferably stored in the evaluation unit.

Machining within the meaning of the invention refers both to a purposeful machining of a workpiece that is to be manufactured as an end product and to the machining of a dummy workpiece for testing purposes as an alternative or in addition to the workpiece to be actually manufactured. For example, reference values are determined with the aid of the machining of the predetermined dummy workpiece. The machining of the dummy workpiece here only serves to measure the structure-borne sound signal. The dummy workpiece may remain mounted in the abrasive flow machine for a multitude of machining operations.

To be able to better evaluate the structure-borne sound signal measured by the structure-borne sound sensor, the signal may be rectified before further evaluation. The rectified signal can then be used to calculate the root mean square.

The workpiece holder preferably includes a suitable seal for sealing a fluid main channel, in which the abrasive medium moves, wherein a portion to be machined of a surface of the workpiece and/or the opening of the workpiece is part of the fluid main channel.

The media drive device comprises, for example, at least one displacement pump that is adapted to push the abrasive medium through the fluid main channel.

According to one embodiment, the evaluation unit has a look-up table stored therein, from which a material removal on the workpiece and/or a cutting power of the abrasive medium can be read based on the integrated measurand of the root mean square of the measured structure-borne sound signal over time. The values stored in the look-up table are specific to the material of the workpiece and/or to the abrasive medium employed. A look-up table can thus be used to ascertain a material removal, in particular a material removal rate and/or a cutting power in a particularly fast and reliable manner. The values stored in the look-up table were determined, for example, by hardware tests and/or by simulations.

The evaluation unit may include an amplifier for amplifying the signal measured by the structure-borne sound sensor. In this way, a reliable evaluation of the structure-borne sound signals can take place even in the case of weak structure-borne sound signals, for example when there is only a small amount of material removal. This allows a cutting power of the abrasive medium and/or a material removal rate to be ascertained with particularly high accuracy.

For example, the evaluation unit includes at least one filter for filtering out machine frequencies from the signal measured by the structure-borne sound sensor. The filter thus also contributes to the fact that a cutting power of the abrasive medium and/or a material removal rate can be ascertained with particularly high accuracy.

The filter is preferably an analog filter. In particular, the filter is suitable for filtering out low frequencies in the range of less than 50 kHz and/or high frequencies in the range of more than 1 MHz from the structure-borne sound signal. For this purpose, the filter may be an HP filter or a BP filter.

The filter may also be already integrated in the amplifier, which allows the evaluation unit to be particularly compact.

The structure-borne sound sensor may be in direct or indirect contact with the workpiece during operation of the abrasive flow machine. Indirect contact may be effected, for example, via an additional component that is in direct contact with the workpiece. The additional component should be made of a material that is suitable for transmitting the structure-borne sound of the workpiece to the structure-borne sound sensor. For example, a disk or a strip made of aluminum is suitable for this purpose.

Direct contacting has the advantage that the structure-borne sound signal can be transmitted from the workpiece to the structure-borne sound sensor without additional transmission losses. Indirect contacting is advantageous in cases where a direct contacting of the workpiece is difficult due to the size or the geometry of the workpiece.

According to one embodiment, the abrasive flow machine comprises a bypass duct that extends parallel to a fluid main channel, wherein the workpiece is a dummy workpiece arranged in the bypass duct, and wherein the fluid main channel extends over a surface and/or through an opening of an additional workpiece to be machined. Similar to the indirect contacting, this embodiment is suitable when the workpieces being machined are relatively small and the structure-borne sound sensor cannot be arranged on the workpiece to be machined itself.

Furthermore, this embodiment offers the additional advantage that the cutting power of the abrasive medium can be determined on the basis of the structure-borne sound signal measured on the dummy workpiece, independently of the material removal rate. In fact, the material of the dummy workpiece is preferably selected such that no or only very little material removal takes place on the dummy workpiece. As a result, the dummy workpiece is hardly worn during operation of the abrasive flow machine and may remain installed in the abrasive flow machine for the machining of a multitude of workpieces that are to be additionally machined. The structure-borne sound signal measured on the dummy workpiece is therefore caused almost exclusively by the friction of the abrasive medium on the dummy workpiece, with the friction being the greater the more sharp-edged the abrasive particles in the abrasive medium, that is, the better the cutting power of the abrasive medium.

Even if no or only very little material is removed from the dummy workpiece, for the purposes of the invention the movement of the abrasive medium through the dummy workpiece is understood as a machining of a workpiece.

The abrasive flow machine may also comprise two structure-borne sound sensors, wherein, during operation of the abrasive flow machine, a respective structure-borne sound sensor is positioned on the dummy workpiece in the bypass duct and also on the additional workpiece to be machined. This allows an even more accurate evaluation, since, as previously discussed, the cutting power of the abrasive medium can be analyzed in the bypass duct in isolation from the material removal, whereas the structure-borne sound signal measured on the additional workpiece is also influenced by the material removal rate. In particular, two different signals can be measured in this embodiment, with a difference between the two signals correlating with a surface improvement. Given constant machine settings, both a media condition or quality and a surface improvement can thereby be monitored.

Preferably, the abrasive flow machine comprises a checking unit which is adapted to adjust at least one process parameter based on the cutting power and/or the material removal rate ascertained by the evaluation unit, in particular during the machining of a workpiece. In this way, a decreasing cutting power of the abrasive medium can be compensated at least to a certain extent, so that the abrasive medium can be utilized for a longer period of time or the workpiece is machined more effectively.

The process parameters that can be adjusted by the checking unit are, for example, a flow velocity of the abrasive medium through the opening of the workpiece, a fluid pressure of the abrasive medium, a back pressure on the abrasive medium, and/or a temperature of the abrasive medium. By increasing the flow velocity, the material removal rate can be increased, in particular if the quality of the abrasive medium remains constant. The fluid pressure of the abrasive medium and/or the back pressure on the abrasive medium can be used to adjust a contact pressure of the abrasive medium, in particular of the abrasive particles, against a surface of the workpiece. The temperature has an influence on the viscosity of the abrasive medium, which in turn can have an effect on the flow velocity of the abrasive medium.

Optionally, the abrasive flow machine includes a fluid conveying device that is adapted to discharge worn abrasive medium from the abrasive flow machine and to supply unused abrasive medium. Such a fluid conveying device allows an automatic replacement of the abrasive medium to be effected when the latter is worn out.

The invention further provides a method of ascertaining a material removal and/or a rate of material removal on a workpiece when the workpiece is machined in an abrasive flow machine, comprising the steps of:

- passing an abrasive medium over a surface and/or through an opening of a workpiece to be machined;
- measuring the structure-borne sound generated in the workpiece during machining;
- forming a root mean square of the measured structure-borne sound signal;
- integrating the root mean square over the machining time; and
- determining the material removal and/or the rate of material removal on the workpiece on the basis of the integral formed.

The method according to the invention makes it possible to determine already during the machining of the workpiece in the abrasive flow machine whether sufficient material removal has taken place, without the workpiece having to be removed from the abrasive flow machine. Compared with the known methods, in which only the root mean square of the structure-borne sound signal is formed, forming the integral of the root mean square of the structure-borne sound signal has the advantage that the absolute material removal that has taken place can be ascertained at any point in time during machining. Since the amounts of material removed are usually very small and measurement errors occur when weighing the workpiece, the method according to the invention can be used to ascertain a material removal even more precisely than by weighing the workpiece before and after machining.

The material removal rate is greater in particular immediately after the start of machining a workpiece than at a later point in time. The lower the surface roughness of the workpiece, the less material is removed. When the material removal rate remains constant, this is an indication that the machining of the workpiece has been completed or that a surface roughness of the workpiece cannot be further improved with the abrasive medium used in the abrasive flow machine. In addition to the material removal rate, the integrated root mean square of the structure-borne sound signal can also be used to determine a cutting power of the abrasive medium. This allows a conclusion to be drawn about a degree of wear of the abrasive medium.

Based on a material removal rate, for example, at least one of the following process parameters is set: a flow velocity of the abrasive medium, a fluid pressure of the abrasive medium, a back pressure on the abrasive medium, and/or a temperature of the abrasive medium. A suitable setting of the process parameters allows the workpiece to be machined particularly efficiently.

According to one embodiment, at least one process parameter is adjusted if the material removal rate measured during machining of the workpiece deviates from a desired material removal rate by more than a defined tolerance value. This allows the machining of the workpiece to take place in a particularly controlled manner. In addition, by adjusting the process parameters, the machining time for the individual workpieces to be machined can be kept constant. This means that by adjusting the process parameters, it is possible to sufficiently abrade the individual workpieces within a defined machining time even when the cutting power of the abrasive medium decreases.

For example, a reference curve that describes a desired profile of the material removal rate is established by storing a profile of the material removal rate of a machined workpiece in an evaluation unit, wherein a tolerance range about the reference curve is defined, within which the material removal rate should preferably be. Establishing such a reference curve is very simple. Based on such a reference curve or on the tolerance range, it is particularly easy to monitor whether the material removal rate is within a reasonable range or whether effective machining of the workpiece is performed.

The workpiece that serves to establish the reference curve is preferably measured after the machining process. If the reference workpiece is found to be of good quality, the reference curve is stored. Should the workpiece not be in order in terms of quality, the process is repeated with a further workpiece.

The reference curve is, for example, specific to the machining of particular workpieces with a particular abrasive medium. For differently shaped workpieces and/or for machining using a different abrasive medium, a separate reference curve is preferably prepared in each case.

If the actual profile of the material removal rate is outside the tolerance range, preferably at least one process parameter is adjusted during the machining of the workpiece. In this way, it is possible to react particularly quickly to irregularities in the machining process.

Storing the reference curve and/or matching the material removal rate with the reference curve is preferably performed by a software that may be stored in the checking unit or in the evaluation unit.

Based on a material removal rate, a request to replace at least part of the abrasive medium may be made. A user therefore need no longer manually check whether the cutting power of the abrasive medium is still sufficient.

The request for replacement occurs in particular when a desired surface finish of the workpiece can no longer be achieved within an acceptable machining time with the abrasive material used.

In addition to the aforementioned structure-borne sound signal, a further structure-borne sound signal may be measured on a dummy workpiece and a difference of the two structure-borne sound signals may be formed in order to monitor an improvement in the surface finish of the workpiece. This is possible because a difference of the two signals correlates with a surface improvement. In this way, the surface improvement can be monitored even more accurately.

Monitoring the surface improvement, however, does not necessarily require a second structure-borne sound sensor or a dummy workpiece. The surface improvement can also be monitored by comparing the structure-borne sound signal that occurs at the beginning of a machining process with the structure-borne sound signal that occurs at the end of a machining process, in particular by forming a difference of the two signals.

Moreover, a structure-borne sound signal that occurs at the beginning of a machining process of a workpiece may be compared with the structure-borne sound signal that occurs at the end of an immediately previously manufactured workpiece in order to determine a required surface improvement, in particular on the basis of a difference between the two structure-borne sound signals. Based on the required surface improvement and taking into account the material removal rate, the evaluation unit may ascertain an optimum machining time after which a desired surface improvement is achieved. In this way, the machining process can proceed in a particularly time-optimized manner. Of course, this only applies if the two workpieces machined one after the other are of the same type.

Replacement of the abrasive medium may be performed manually or automatically. For example, a user may receive a request to manually replace a predefined portion of the abrasive medium. Alternatively, only an indication that a replacement of the abrasive medium is taking place may be provided while the automatic replacement is effected.

Automatic replacement is effected, for example, by a fluid conveying device that is suitable to discharge worn abrasive medium from the abrasive flow machine and to supply unused abrasive medium.

The invention also provides a method of determining the cutting power of an abrasive medium, including the steps of:

- passing an abrasive medium over a surface and/or through an opening of a reference workpiece;
- measuring the structure-borne sound generated in the workpiece during machining;
- forming a root mean square of the measured structure-borne sound signal;
- integrating the root mean square over the machining time;
- dividing the integrated measurand by the media flow rate; and
- determining the cutting power of the abrasive medium using the divided integrated measurand.

A method of this type may be used to examine various abrasive media for their cutting power, for example when developing new abrasive media.

BRIEF DESCRIPTION OF THE DRAWINGS

Further advantages and features of the invention will be apparent from the description below and from the accompanying drawings, to which reference is made and in which.

DESCRIPTION OF THE INVENTION

Figure 1A:
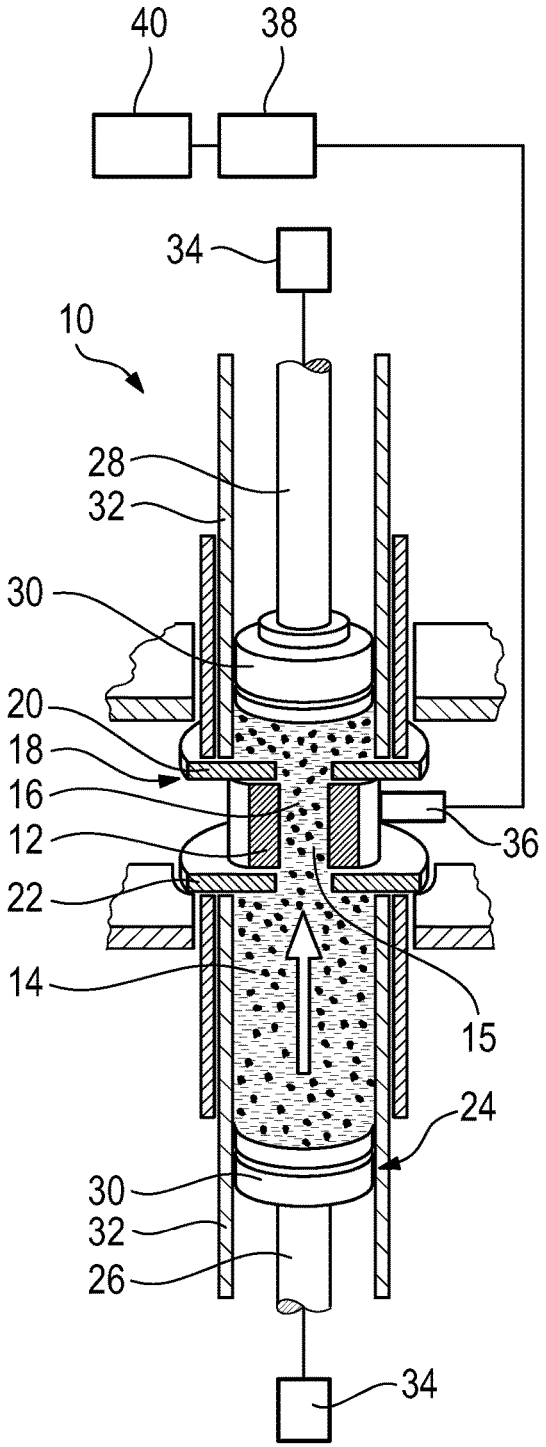
FIGS. 1*a* and 1*b* each show a part of an abrasive flow machine according to the invention.
Figure 1B:
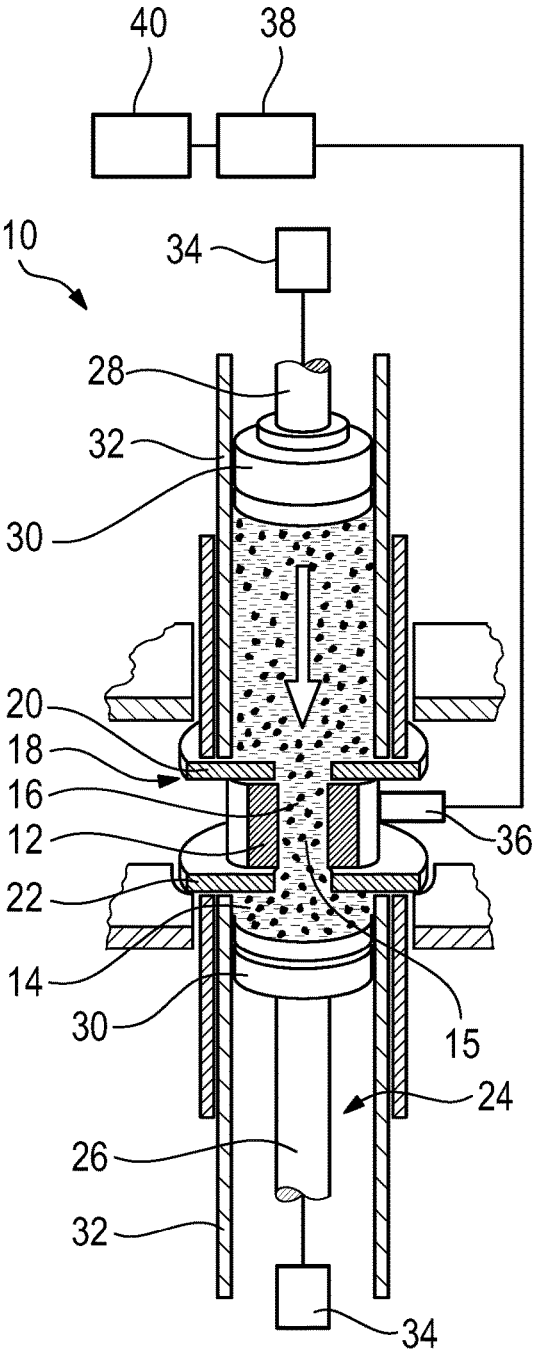

FIGS. 1*a* and 1*b* each show a sectional representation of an abrasive flow machine 10 for machining a workpiece 12 with a viscous abrasive medium 14. To machine the workpiece 12, the abrasive medium 14 can be moved through an opening 16 in the workpiece 12 to be machined.

In particular, the abrasive medium 14 moves in a fluid main channel 15 that extends through the opening 16 of the workpiece 12.

Alternatively or additionally, the abrasive medium 14 may be moved across a surface of the workpiece 12 that is outside of the opening 16, with the fluid main channel 15 being at least partly defined by the surface of the workpiece 12.

FIGS. 1*a* and 1*b* depict the abrasive flow machine 10 in respective different states in which the abrasive medium 14 is moved in opposite directions, as illustrated by arrows, i.e. is pumped back and forth.

For mounting the workpiece 12, the abrasive flow machine 10 comprises a workpiece holder 18, which includes two parts 20, 22 adapted to be positioned on opposite sides of the workpiece 12. During machining, the workpiece 12 is, e.g., axially clamped between the two parts 20, 22 of the workpiece holder 18.

In order to obtain a particularly good sealing, the parts 20, 22 may have seals fitted to them, which rest against the workpiece 12 during machining. The seals are preferably metal seals or ceramic seals; rubber seals would in fact dampen the structure-borne sound signal.

The abrasive flow machine 10 further comprises a media drive device 24 that is adapted to move the abrasive medium 14 over a surface of a workpiece and/or through the opening 16 of the workpiece 12. This process removes material from the workpiece 12, thereby finishing and polishing the surface of the workpiece 12.

In the exemplary embodiment shown, the media drive device 24 comprises two displacement pumps 26, 28; depending on the direction of flow of the abrasive medium 14, one of the two displacement pumps 26, 28 forces the abrasive medium 14 through the opening 16 and the respective other displacement pump 26, 28 constitutes a device counteracting the abrasive medium 14 and which counteracts the flow of the abrasive medium 14. A displacement pump 26, 28 each has a piston 30 guided in a cylinder 32.

The media drive device 24 furthermore comprises a drive element 34 for each displacement pump 26, 28, the drive element being, for example, a hydraulic actuating element or a linear motor actuating element.

When the workpiece 12 is machined using the abrasive medium 14, structure-borne sound waves are produced in it, in particular acoustic and/or elastic waves. Based on the intensity of the structure-borne sound waves, conclusions can be drawn about the effectiveness and the extent of the machining of the workpiece 12. In particular, an intensity of the structure-borne sound waves correlates with a rate of material removal on the workpiece 12 and/or with a cutting power of the abrasive medium 14.

The cutting power of the abrasive medium 14 is given in units of millivolt-seconds per liter [mV·s/l].

The cutting power indicates how much material is removed per liter of abrasive medium 14 moved over the workpiece 12.

To measure the structure-borne sound waves, the abrasive flow machine 10 comprises a structure-borne sound sensor 36 that is in contact with the workpiece 12 to be machined.

Furthermore, the abrasive flow machine 10 comprises an evaluation unit 38, in particular an electronic evaluation unit 38. The evaluation unit 38 can receive the structure-borne sound signal measured by the structure-borne sound sensor 36 and, in particular by means of software, form the root mean square of the structure-borne sound signal and integrate it over time. Alternatively, the evaluation unit 38 may, for example, already receive the root mean square of the structure-borne sound signal from an amplifier. The structure-borne sound signal is measured in millivolts or milliamperes, for example.

For evaluation of the structure-borne sound signal, it is preferably rectified before the root mean square is formed.

Figure 2:
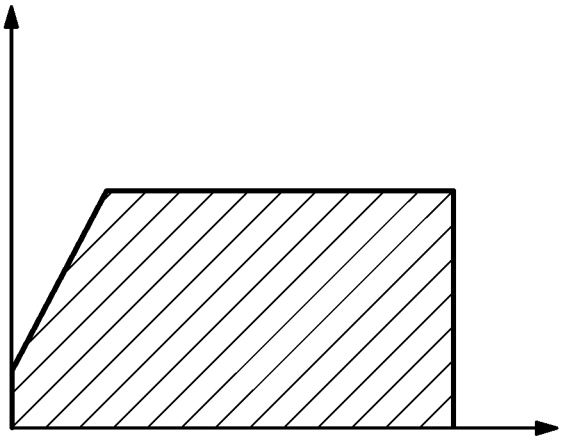
FIG. 2 shows the profile of the root mean square of a structure-borne sound signal.

The profile of the root mean square of the structure-borne sound signal in millivolts over time in seconds is shown for a machining operation as an example in FIG. 2.

In addition, the evaluation unit 38 is suitable for inferring a cutting power of the abrasive medium 14 and/or a rate of material removal on the workpiece 12 based on an integrated measurand of the root mean square of the structure-borne sound measured by the structure-borne sound sensor 36 over time.

To draw conclusions about the material removal rate or the cutting power, in particular the material removal is first determined in the evaluation unit 38 on the basis of the integral formed. In fact, the integrated measurand is specific to a particular material removal.

To determine the material removal rate, the evaluation unit 38 is configured to relate the material removal to the machining time.

To determine the cutting power, the evaluation unit 38 is configured to divide the integrated measurand by the media flow rate.

Figure 5:
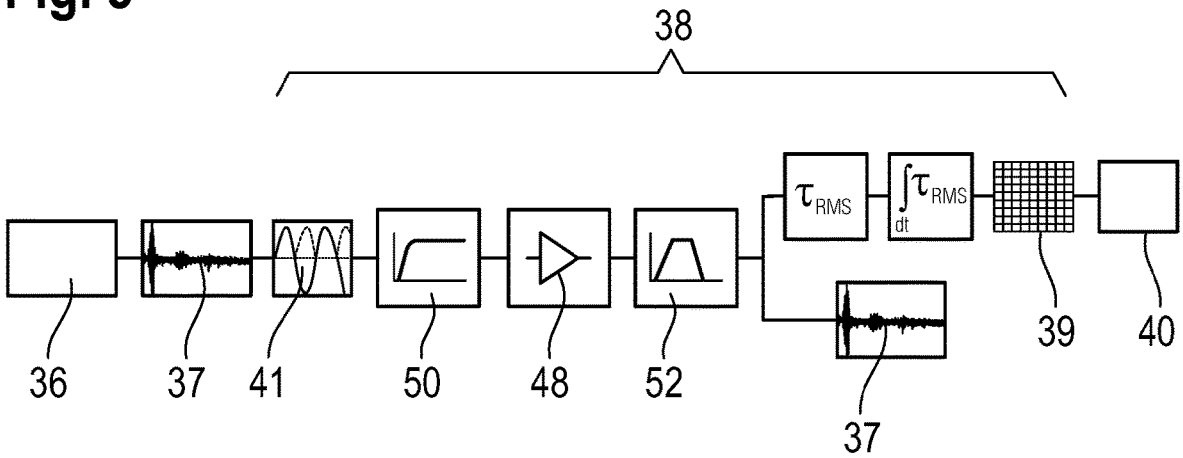
FIG. 5 shows a flow chart for the processing of a structure-borne sound signal.

For evaluation of the structure-borne sound signal, the evaluation unit 38 may have a look-up table 39 stored therein, from which a material removal on the workpiece 12 and/or a cutting power of the abrasive medium 14 can be read on the basis of the integrated measurand of the root mean square of the measured structure-borne sound signal over time. Such a look-up table 39 is illustrated in FIG. 5 below.

The abrasive flow machine 10 further comprises a checking unit 40, which is adapted, based on the cutting power and/or the material removal rate ascertained by the evaluation unit 38, to adjust at least one process parameter, in particular during the machining of a workpiece 12. In this way, it is possible to react to changes in the cutting power of the abrasive medium 14 and/or to other fluctuations in the machining process, for example to temperature fluctuations.

The process parameters that can be adapted by the checking unit 40 include, for example, a flow velocity of the abrasive medium 14, a fluid pressure of the abrasive medium 14, a back pressure on the abrasive medium 14, and/or a temperature of the abrasive medium 14.

With the exception of the temperature of the abrasive medium 14, the aforementioned process parameters can be set by means of the media drive device 24. For this purpose, a position of the two displacement pumps 26, 28 relative to each other and/or a speed of movement of the individual displacement pumps 26, 28 can be adjusted.

For example, when the distance of the displacement pumps 26, 28 or of the pistons 30 from each other is reduced, the fluid pressure of the abrasive medium 14 is increased. As a result, the abrasive particles of the abrasive medium 14 are pressed against the surface to be machined of the workpiece 12 with a higher contact force and a material removal rate can be increased.

By increasing the flow velocity, the material removal rate can also be increased since more abrasive particles are moved over the surface of the workpiece 12 in the same period of time.

If the pistons 30 of the two displacement pumps 26, 28 are moved at different speeds, in particular if a piston 30 mounted upstream in the direction of flow is moved more slowly than a piston 30 mounted downstream or its movement is met with greater resistance, a counterpressure on the abrasive medium 14 can be increased. Whether a piston 30 is mounted upstream or downstream depends on the respective current direction of flow of the abrasive medium 14, which changes after each machining cycle.

To adjust the temperature of the abrasive medium 14, a heating and/or cooling sleeve or the like may additionally be provided. The heating and/or cooling sleeve is arranged around the cylinder 32, for example.

In the exemplary embodiment illustrated in FIGS. 1*a* and 1*b*, the structure-borne sound sensor 36 is in direct contact with the workpiece 12.

Figure 3:
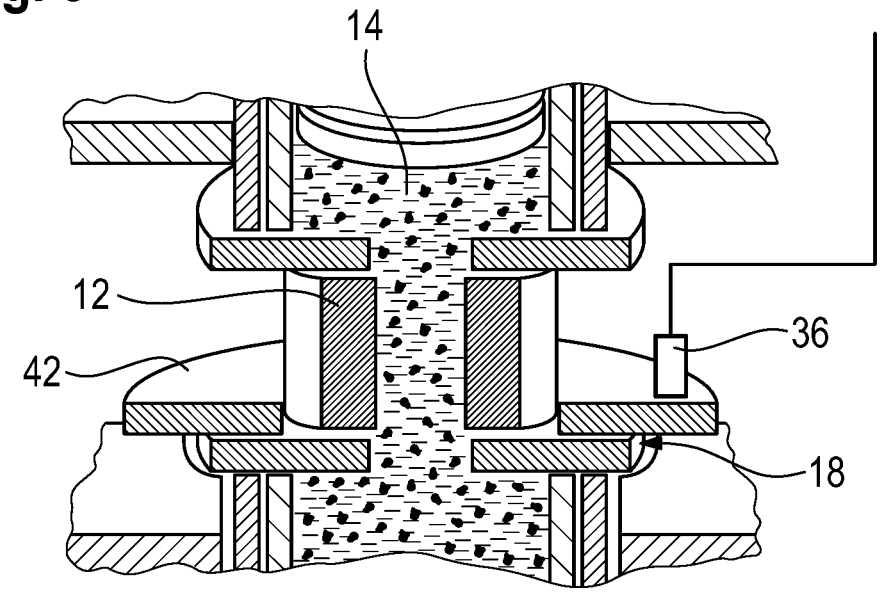
FIG. 3 shows a partial area of a further abrasive flow machine according to the invention in the region of a workpiece holder.

It is, however, also conceivable that the structure-borne sound sensor 36 is in indirect contact with the workpiece 12, in particular via an additional component 42 such as an aluminum disk. This is illustrated schematically in FIG. 3, where for the sake of simplicity only the area around the workpiece 12 is shown. The additional component 42 may be part of the workpiece holder 18 here.

Figure 4:
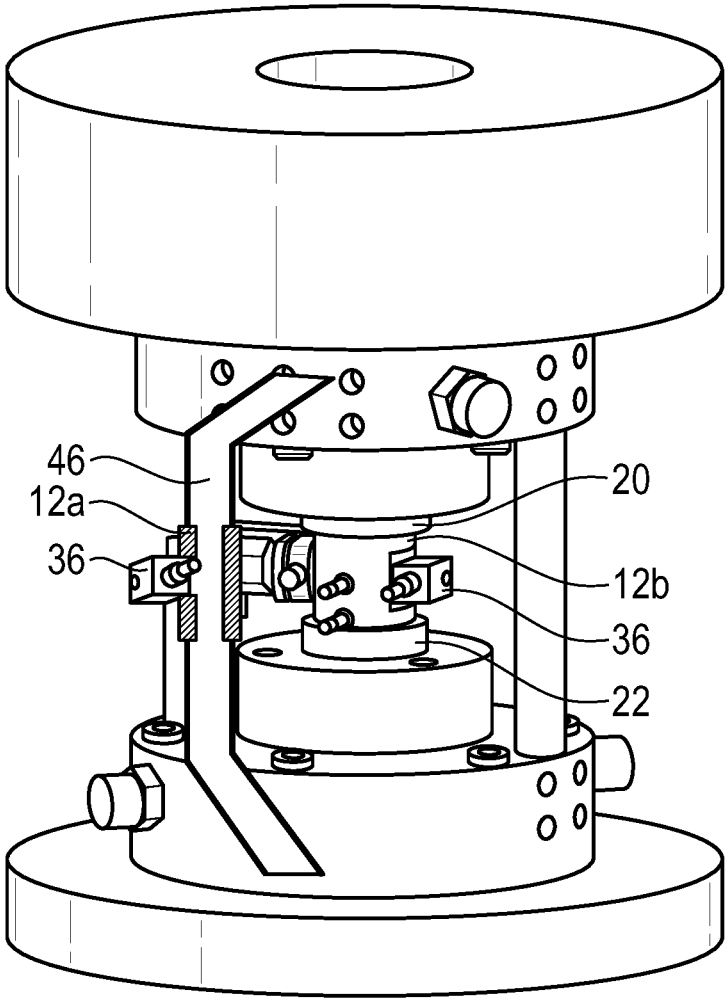
FIG. 4 shows a further abrasive flow machine according to the invention.

FIG. 4 shows a further abrasive flow machine 10 according to the invention. The same reference numerals are used in the following for identical structures with identical functions that are known from the embodiment above, and reference is made to the preceding discussions in this respect; in the following, the differences of the respective embodiments will be discussed in order to avoid repetition.

In the embodiment shown in FIG. 4, the abrasive flow machine 10 comprises a bypass duct 46 that extends parallel to the fluid main channel 15, which is not visible in FIG. 4.

In this case, the workpiece 12 is a dummy workpiece 12*a* disposed in the bypass duct 46.

In the exemplary embodiment illustrated, the fluid main channel 15 extends through the opening 16 of an additional workpiece 12*b* to be machined.

Alternatively, as already mentioned previously, the fluid main channel 15 may extend over a surface of the workpiece 12*b* to be machined.

In this case, the abrasive flow machine 10 may comprise two structure-borne sound sensors 36; during operation of the abrasive flow machine 10, a respective structure-borne sound sensor 36 is positioned on the dummy workpiece 12*a* in the bypass duct 46 and also on the additional workpiece 12*b* to be machined. This allows the machining process to be monitored even more closely.

Such a structure of the abrasive flow machine is advantageous in particular if the workpiece 12*b* to be machined is shaped such that the structure-borne sound sensor 36 cannot be properly mounted to the workpiece 12*b*, in particular if the workpiece 12*b* is relatively small.

A further advantage of such a structure of the abrasive flow machine is that the cutting power of the abrasive medium 14 can be determined on the basis of the structure-borne sound signal measured at the dummy workpiece 12*a*, independently of the material removal rate. In addition, such a setup can be used to monitor the surface improvement particularly precisely by forming a difference of the structure-borne sound signal measured at the dummy workpiece 12*a* and that measured at the workpiece 12*b* to be machined. This difference correlates with the surface improvement.

The dummy workpiece 12*a* is preferably made of a harder material than the workpiece 12*b*. As a result, no or only little material is removed from the dummy workpiece 12*a*, and it can remain in the abrasive flow machine 10 for a large number of machining processes.

For holding the dummy workpiece 12*a*, preferably a workpiece holder is provided which, for the sake of simplicity, is not shown and which is configured like the workpiece holder 18.

In a further embodiment that is not illustrated, a structure-borne sound sensor 36 may be arranged only at the dummy workpiece 12*a*. This is the case in particular if the workpiece 12*b* additionally to be machined is either too small or is shaped in such a way that the structure-borne sound sensor 36 cannot be properly positioned at the workpiece 12*b*.

FIG. 5 illustrates the processing of a structure-borne sound signal that was measured by the structure-borne sound sensor 36.

The structure-borne sound signal is first output as a raw signal 37 by the structure-borne sound sensor 36.

Subsequently, the raw signal 37 is rectified in a rectifier 41, which may be part of the evaluation unit 38.

FIG. 5 further illustrates that the evaluation unit 38 may include an amplifier 48 for amplifying the structure-borne sound signal measured by the structure-borne sound sensor 36.

Furthermore, the evaluation unit 38 optionally includes a filter, in particular an HP filter 50 and/or a band-pass filter 52 for filtering out machine frequencies from the signal measured by the structure-borne sound sensor 36.

The rectifier 41, the HP filter 50, the amplifier 48, and the band-pass filter 52 are contained, for example, in a so-called acoustic emission coupler, which are distributed, for example, under the trade name of Piezotron® coupler. Such acoustic emission couplers already have an integrated RMS converter for evaluation of the structure-borne sound signal. That is, such an acoustic emission coupler can already determine the root mean square of the structure-borne sound signal and make it available for further evaluation in the evaluation unit 38. In addition, the raw signal of the structure-borne sound signal can be made available.

In the following, a method according to the invention of ascertaining a material removal and/or a rate of material removal on a workpiece 12, 12*a*, 12*b* when the workpiece 12, 12*a*, 12*b* is machined in an abrasive flow machine 10 and/or of determining a cutting power of the abrasive medium 14 is discussed, in particular when machining the workpiece 12, 12*a*, 12*b* in an abrasive flow machine 10 as described in connection with FIGS. 1 to 4.

When machining a workpiece 12, an abrasive medium 14 is directed over a surface and/or through an opening 16 of the workpiece 12, 12*a*, 12*b* to be machined. This is performed in particular by means of the media drive device 24 described above.

In the process, the structure-borne sound produced in the workpiece 12, 12*a*, 12*b* during machining is measured, in particular using the structure-borne sound sensor 36.

Subsequently, the root mean square of the measured structure-borne sound signal $\tau_{RMS}$ is ascertained in the evaluation unit 38, in particular in an acoustic emission coupler.

Following this, the root mean square is integrated over the machining time.

The material removal and/or the material removal rate on the workpiece 12, 12*a*, 12*b* may then be determined using the integral formed.

Alternatively or additionally to the material removal and/or the material removal rate, a cutting power of the abrasive medium 14 may be determined on the basis of the integral formed.

In addition to the integrated measurand, the raw signal 37 of the structure-borne sound signal may also be output.

If the material removal rate measured during machining of the workpiece 12, 12*a*, 12*b* deviates from a desired material removal rate by more than a defined tolerance value, preferably at least one process parameter will be adapted.

In particular, at least one of the following process parameters is adjusted based on a material removal rate: a flow velocity of the abrasive medium 14, a fluid pressure of the abrasive medium 14, a back pressure on the abrasive medium 14, and/or a temperature of the abrasive medium 14.

To be able to determine in a particularly simple way whether the material removal rate is within a desired range, a reference curve is preferably established which describes a desired profile of the material removal rate.

The reference curve is established, for example, by plotting, during machining, a profile of the material removal rate of a machined workpiece 12, 12*a*, 12*b*. The machined workpiece 12, 12*a*, 12*b* is subsequently subjected to a quality inspection and a measurement of the material removal. If the workpiece 12, 12*a*, 12*b* has been found to be in order, the material removal rate as plotted is stored as a reference curve in the evaluation unit 38.

Figure 6:
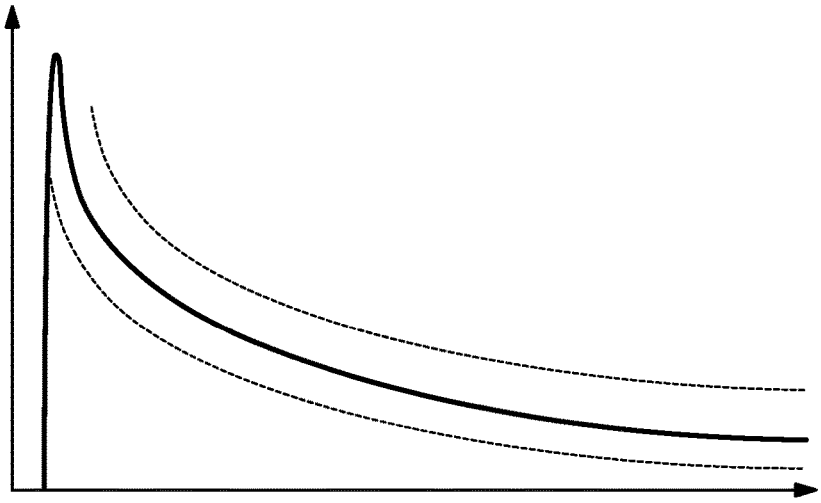
FIG. 6 shows a reference curve describing a desired profile of the material removal rate.

Such a reference curve is illustrated in FIG. 6. Here, the profile of the material removal rate has been plotted over time.

In addition, a tolerance range about the reference curve is defined; the material removal rate is to be within this tolerance range. The tolerance range is illustrated in FIG. 6 by dashed lines about the reference curve.

If it is found during the machining of a workpiece 12, 12*a*, 12*b* that the actual profile of the material removal rate is outside the tolerance range, at least one process parameter, for example, is adjusted during the machining of the workpiece 12, 12*a*, 12*b*. This is to achieve that the material removal rate again follows the profile of the reference curve.

More precisely, it is to be achieved that the machined workpiece 12, 12*a*, 12*b* is of good quality after the machining has been completed.

However, when the abrasive medium 14 is worn beyond a certain extent, that is, when a cutting performance of the abrasive medium 14 has significantly decreased, the profile of the material removal rate can only be slightly influenced by a variation of process parameters. Effective machining of a workpiece 12, 12*a*, 12*b* that leads to an acceptable result in terms of quality is then no longer possible.

Figure 7:
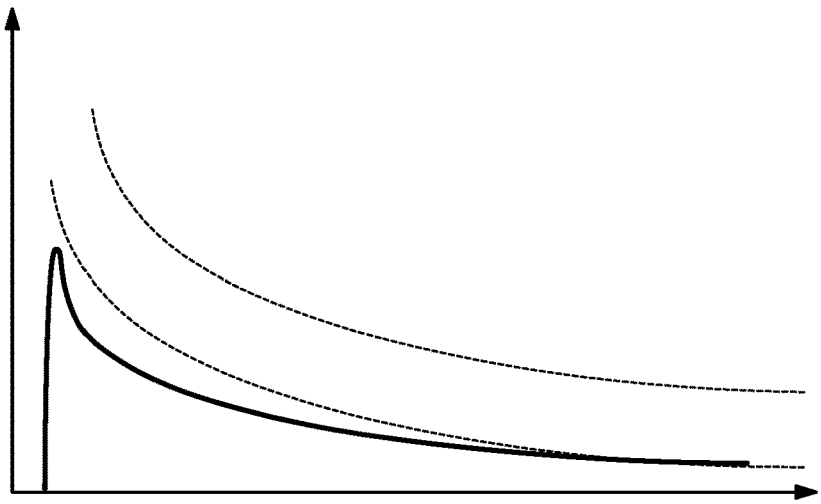
FIG. 7 shows a profile of a material removal rate during machining of a workpiece.

Therefore, preferably based on a material removal rate, there will be a request to replace at least part of the abrasive medium 14, in particular when the actual material removal rate is below the tolerance range, as shown in FIG. 7, for example.

It is furthermore apparent from FIGS. 6 and 7 that the material removal rate approaches a constant value towards the end of the machining time. The difference between a maximum value occurring at the beginning of the machining time and the final value at the end of the machining time describes the surface improvement obtained.

In order to ascertain an optimum machining duration for a workpiece 12, 12*b*, at the beginning of a machining process the final value of the material removal rate of an already machined workpiece 12, 12*b* may be compared with the maximum value of a subsequently produced workpiece, in particular the difference may be formed. In this case, the difference correlates with the desired surface improvement.

According to a further method according to the invention, a cutting power of an abrasive medium 14 can be determined by passing abrasive medium 14 over a surface and/or through an opening of a reference workpiece 12, measuring the structure-borne sound generated within the reference workpiece 12, and measuring the root mean square of the measured structure-borne sound signal. Subsequently, the integral is formed over the root mean square and the integrated measurand is divided by the media flow rate of the cutting medium 14. The divided integrated measurand can be used to determine the cutting power of the abrasive medium 14. This makes the method according to the invention suitable for examining or for developing novel abrasive media.

If it is only intended to examine the cutting power of an abrasive medium 14 without intending to produce a workpiece, usually only a dummy workpiece 12*a* or a reference workpiece is arranged in the abrasive flow machine 10.

Figure 8A:
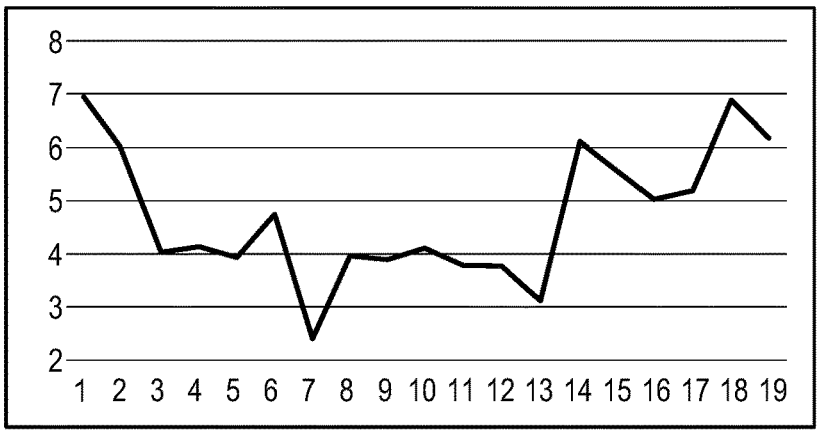
FIGS. 8*a* and 8*b* show profiles of a directly measured material removal rate and an indirectly ascertained material removal rate, respectively.
Figure 8B:
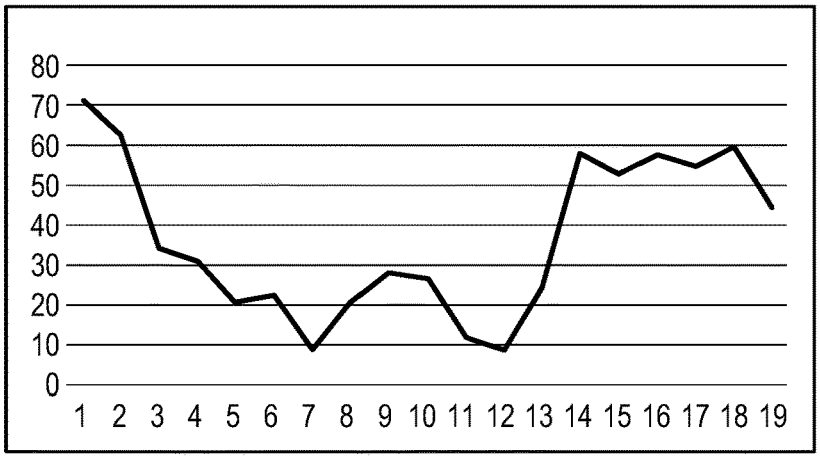

FIGS. 8*a* and 8*b* graphically illustrate a profile of a directly measured material removal rate over a number of machining cycles (FIG. 8*a*) and a profile of an indirectly ascertained material removal rate, that is, a profile of the integrated measurand of the root mean square of the structure-borne sound signal over the number of machining cycles (FIG. 8*b*).

The directly measured material removal rate is given in mg/L here. The indirectly measured material removal rate is given in mV·s/L.

Here, the material removal rate or the integrated measurand is ascertained individually for each machining cycle. In particular, a machining cycle corresponds to a cycle in which the abrasive medium 14 is moved in a flow direction by the media drive device 24.

It is apparent from FIGS. 8*a* and 8*b* that the profile of the directly measured material removal rate strongly correlates with the profile of the integrated measurand over the machining cycles. This clearly shows that the integrated measurand of the root mean square of the structure-borne sound measured by the structure-borne sound sensor 36 over time can be used to draw conclusions about a cutting power of the abrasive medium 14 and/or a material removal rate on the workpiece 12.

The invention claimed is:

1. An abrasive flow machine for moving abrasive media over a surface of a workpiece and/or through the opening of a workpiece, comprising a media drive device which is adapted to move the abrasive medium over a surface of a workpiece and/or through the opening of the workpiece in a flow direction;

a workpiece holder for mounting the workpiece, having two parts adapted to be positioned on opposite sides of the workpiece;

a structure-borne sound sensor for measuring structure-borne sound generated in a workpiece when the latter is machined with an abrasive medium; and an electronic evaluation unit on which software is stored which is configured such that the evaluation unit is configured to receive a raw signal of the structure-borne sound sensor and by means of the software to process the raw signal of the structure-borne sound sensor to determine a continuous value of the root mean square of the structure-borne sound measured by the structure-borne sound sensor over time and to integrate the root mean square of the structure-borne sound, wherein the evaluation unit is adapted to infer a cutting power of the abrasive medium and/or a rate of material removal on the workpiece, wherein the cutting power and/or material removal rate is evaluated based on the integrated measurand that is formed by the evaluation unit over the continuous value of the root mean square of the structure-borne sound measured by the structure-borne sound sensor over time, wherein the integrated measurand of the root mean square of the structure-borne sound measured by the structure-borne sound sensor over time is specific to a particular material removal, and wherein the material removal rate is calculated by dividing the value of the material removal by the machining time and/or the cutting power is ascertained by dividing the material removal by the media flow rate and wherein the media drive device is further configured to change a flow velocity, fluid pressure, or back pressure of the abrasive medium based upon the material removal rate.

2. The abrasive flow machine according to claim 1, wherein the evaluation unit has a look-up table stored therein, from which a material removal on the workpiece and/or a cutting power of the abrasive medium can be read based on the integrated measurand of the root mean square of the measured structure-borne sound signal over time.

3. The abrasive flow machine according to claim 1, wherein the evaluation unit includes an amplifier for amplifying the signal measured by the structure-borne sound sensor.

4. The abrasive flow machine according to claim 1, wherein the evaluation unit includes at least one filter for filtering out machine frequencies from the signal measured by the structure-borne sound sensor.

5. The abrasive flow machine according to claim 1, wherein the structure-borne sound sensor is in direct or indirect contact with the workpiece during operation of the abrasive flow machine.

6. The abrasive flow machine according to claim 1, wherein the abrasive flow machine comprises a bypass duct that extends parallel to a fluid main channel, and in that the workpiece is a dummy workpiece arranged in the bypass duct, the fluid main channel extending over a surface and/or through an opening of an additional workpiece to be machined.

7. The abrasive flow machine according to claim 6, wherein the abrasive flow machine comprises two structure-borne sound sensors, wherein, during operation of the abrasive flow machine, a respective structure-borne sound sensor is positioned on the dummy workpiece in the bypass duct and also on the additional workpiece to be machined.

* * * * *